US009312619B2

(12) United States Patent
Tseng et al.

(10) Patent No.: US 9,312,619 B2
(45) Date of Patent: Apr. 12, 2016

(54) NETWORK CARD FIXING STRUCTURE AND NETWORK CARD MODULE

(71) Applicant: Wistron Corporation, New Taipei (TW)

(72) Inventors: Tien-Chung Tseng, New Taipei (TW); Zih-Yong Tang, New Taipei (TW)

(73) Assignee: Wistron Corporation, New Taipei (TW)

( * ) Notice: Subject to any disclaimer, the term of this patent is extended or adjusted under 35 U.S.C. 154(b) by 14 days.

(21) Appl. No.: 14/497,325

(22) Filed: Sep. 26, 2014

(65) Prior Publication Data

US 2015/0372405 A1 Dec. 24, 2015

(30) Foreign Application Priority Data

Jun. 20, 2014 (TW) ..... 103210995 U

(51) Int. Cl.

| | |
|---|---|
| ***H01R 13/62*** | (2006.01) |
| ***H01R 12/73*** | (2011.01) |
| *H01R 12/57* | (2011.01) |
| *H01R 13/58* | (2006.01) |

(52) U.S. Cl.

CPC ..... *H01R 12/73* (2013.01); *H01R 12/57* (2013.01); *H01R 13/582* (2013.01)

(58) Field of Classification Search

CPC ..... H01R 12/7005; H01R 12/721; H01R 13/639; H01R 13/6658; H01R 12/716; H01R 13/514; H01R 13/6275; H01R 13/6594

See application file for complete search history.

(56) References Cited

U.S. PATENT DOCUMENTS

| | | | | |
|---|---|---|---|---|
| 7,572,145 | B1 * | 8/2009 | Wu | H01R 13/6658 439/460 |
| 7,845,960 | B2 * | 12/2010 | Li | H01R 12/714 439/79 |
| 8,052,430 | B2 * | 11/2011 | Wu | H01R 9/032 439/76.1 |
| 8,300,418 | B2 * | 10/2012 | Sun | H05K 7/1405 361/759 |
| 8,517,744 | B2 | 8/2013 | Lin | |
| 2012/0262896 | A1 | 10/2012 | Liu | |

* cited by examiner

*Primary Examiner* — Xuong Chung Trans
(74) *Attorney, Agent, or Firm* — Jianq Chyun IP Office

(57) ABSTRACT

A network card fixing structure adapted to fix a network card on a circuit board is provided. The network card fixing structure includes a main body, at least one cable arranging structure and a fixing component. The main body has a fixing slot, wherein the network card is fixed in the fixing slot. The cable arranging structure is connected to the main body, wherein a cable is connected to the network card and is position-limited on the main body by the cable arranging structure. The fixing component fixes the main body on the circuit board. In addition, a network card module including the network card fixing structure is also provided.

18 Claims, 7 Drawing Sheets

NETWORK CARD FIXING STRUCTURE AND NETWORK CARD MODULE

CROSS-REFERENCE TO RELATED APPLICATION

This application claims the priority benefit of Taiwan application serial no. 103210995, filed on Jun. 20, 2014. The entirety of the above-mentioned patent application is hereby incorporated by reference herein and made a part of this specification.

BACKGROUND

1. Technical Field

The invention relates to a fixing structure, and particularly relates to a network card fixing structure and a network card module having the network card fixing structure.

2. Related Art

Along with quick development of technology, portable electronic products such as notebook computers, smart phones, tablet PCs, etc. gradually become popular in the consumer market, and become indispensable tools in modern life. Due to popularisation of wireless local area networks (WLAN), to built-in a WLAN card has become a basic specification of many electronic products.

In order to avoid cable exfoliation of the WLAN card to influence operation of a wireless network of the electronic product, in some electronic products, a metal sheet locked to a circuit board is used to fix the cables, or an adhesive tape is used to fix the cables, though the above methods cannot achieve the effect of stably fixing the network card, and the method of adhesive tape fixing has a disadvantage of inconvenience in rework.

SUMMARY

The invention is directed to a network card fixing structure and a network card module, which has both effects of cable arranging and stable fixing of a network card.

The invention provides a network card fixing structure, which is adapted to fix a network card on a circuit board. The network card fixing structure includes a main body, at least one cable arranging structure and a fixing component. The main body has a fixing slot, where the network card is fixed in the fixing slot. The cable arranging structure is connected to the main body, where a cable is connected to the network card and is position-limited on the main body by the cable arranging structure. The fixing component fixes the main body on the circuit board.

The invention provides a network card module, which is adapted to be fixed on a circuit board. The network card module includes a network card, a cable and a network card fixing structure. The cable is connected to the network card. The network card fixing structure includes a main body, at least one cable arranging structure and a fixing component. The main body has a fixing slot, where the network card is fixed in the fixing slot. The cable arranging structure is connected to the main body, where the cable is position-limited on the main body by the cable arranging structure. The fixing component fixes the main body on the circuit board.

In an embodiment of the invention, the cable has a connection terminal, and is connected to a pad of the network card through the connection terminal. The main body has a pressing portion, and the pressing portion presses the connection terminal on the circuit board.

In an embodiment of the invention, the main body includes a base and a top cover, the fixing slot is formed on the base, and the pressing portion is formed on the top cover. The top cover is adapted to be opened relative to the base to expose the pad, and the top cover is adapted to be closed to the base, so as to press the connection terminal by the pressing portion.

In an embodiment of the invention, the top cover has at least one hook, and when the top cover is closed to the base, the top cover is engaged to the base through the hook.

In an embodiment of the invention, the base has at least one engaging trough, and when the top cover is closed to the base, the hook is engaged to the engaging trough.

In an embodiment of the invention, the main body further includes an elastic portion, where the elastic portion is connected between the base and the top cover, and the top cover is opened or closed relative to the base through elastic deformation of the elastic portion.

In an embodiment of the invention, the base, the top cover and the elastic portion are formed integrally.

In an embodiment of the invention, the fixing component is a locking component, and the locking component is locked to the circuit board and position-limits the main body on the circuit board.

In an embodiment of the invention, the fixing component is an engaging component and is connected to the main body, and the engaging component is engaged to the circuit board to fix the main body on the circuit board.

In an embodiment of the invention, the cable arranging structure has a position limiting space to position-limit the cable in the position limiting space, so as to prevent the cable from separating from the main body.

In an embodiment of the invention, a number of the at least one cable arranging structure is plural, and the cable arranging structures include a first cable arranging structure and a second cable arranging structure, where the first cable arranging structure is located between the fixing slot and the second cable arranging structure, the cable is position-limited to the first cable arranging structure, and the cable is adapted to extend from the first cable arranging structure to the second cable arranging structure along a first direction, and is position-limited to the main body by the second cable arranging structure.

In an embodiment of the invention, the cable arranging structures further include a third cable arranging structure, and the cable is adapted to extend from the first cable arranging structure to the third cable arranging structure along a second direction, and is position-limited to the main body by the third cable arranging structure.

In an embodiment of the invention, the first direction is perpendicular to the second direction.

According to the above descriptions, the main body of the network card fixing structure of the invention has the fixing slot to stably fix the network card therein, and the network card fixing structure further includes the cable arranging structure connected to the main body, which is configured to position-limit the cable connected to the network card to the main body. In this way, the network card fixing structure of the invention has both effects of cable arranging and stable fixing of the network card.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
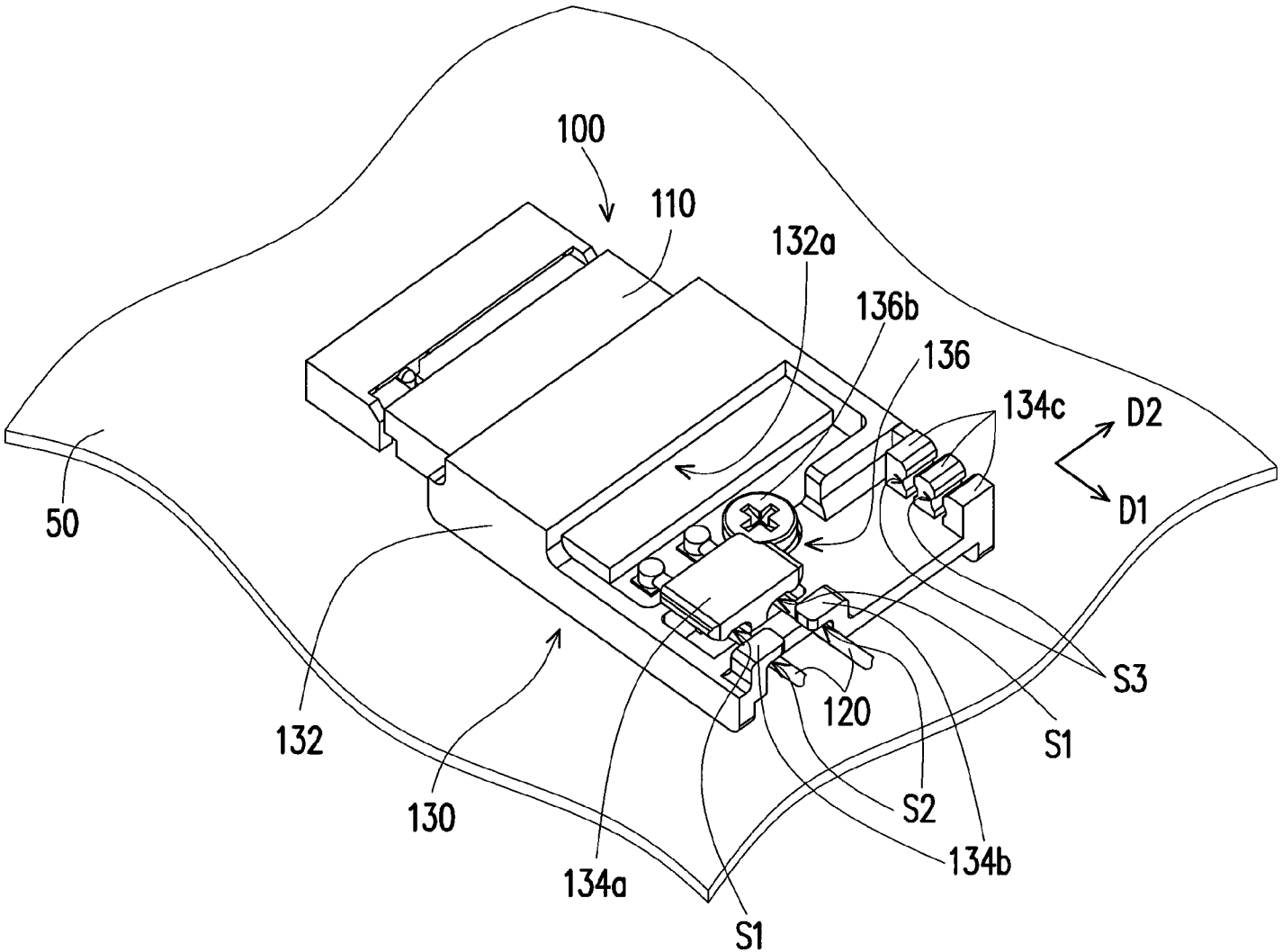
FIG. 1 is a three-dimensional view of a network card module fixed to a circuit board according to an embodiment of the invention.

FIG. 1 is a three-dimensional view of a network card module fixed to a circuit board according to an embodiment of the invention. Referring to FIG. 1, the network card module 100 of the present embodiment is fixed on a circuit board 50 and includes a network card 110; two cables 120 connected to the network card 110 and a network card fixing structure 130. The circuit board 50 is, for example, a mother board of a notebook computer or other types of electronic product, and the network card 110 is, for example, a wireless local area network (WLAN) card or other types of wireless network card, which is not limited by the invention.

The network card fixing structure 130 includes a main body 132, a plurality of cable arranging structures (a first cable arranging structure 134*a*, a second cable arranging structure 134*b* and a third cable arranging structure 134*c*) and a fixing component 136. The main body 132 has a fixing slot 132*a*, and the network card 110 is fixed in the fixing slot 132*a*. The first cable arranging structure 134*a*, the second cable arranging structure 134*b* and the third cable arranging structure 134*c* are connected to the main body 132, and the cables 120 are position-limited on the main body 132 by the first cable arranging structure 134*a* and the second cable arranging structure 134*b*. The fixing component 136 fixes the main body 132 on the circuit board 50.

Under the aforementioned configuration, the fixing slot 132*a* of the main body 132 stably fixes the network card 110 in the main body 132, and the first cable arranging structure 134*a* and the second cable arranging structure 134*b* connected to the main body 132 are configured to position-limit the cables 120 connected to the network card 110 on the main body 132. In this way, the network card fixing structure 130 has both effects of cable arranging and stable fixing of the network card 110.

Figure 2:
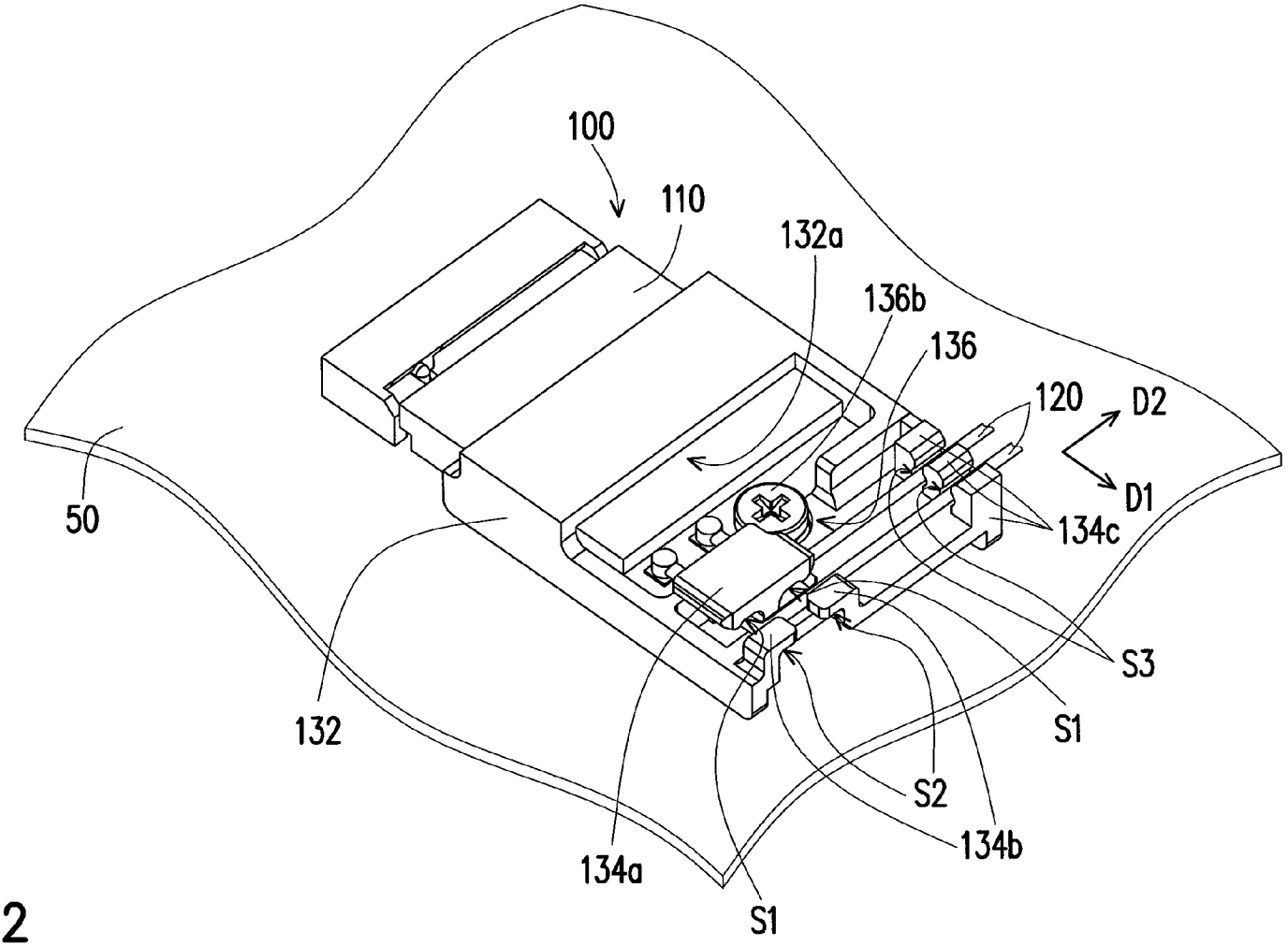
FIG. 2 illustrates a situation that cables of FIG. 1 are changed to extend to a third cable arranging structure.

In detail, the first cable arranging structure 134*a* of the present embodiment is fixed between the fixing slot 132*a* and the second cable arranging structure 134*b*, each of the cables 120 may extend from the first cable arranging structure 134*a* to the second cable arranging structure 134*b* along a first direction D1 as shown in FIG. 1, and is position-limited on the main body 132 by the second cable arranging structure 134*b*. FIG. 2 illustrates a situation that the cables of FIG. 1 are changed to extend to the third cable arranging structure 134*c*. Each of the cables 120 can be changed to extend to the third cable arranging structure 134*c* along a second direction D2 perpendicular to the first direction D1 as that shown in FIG. 2, and is position-limited on the main body 132 by the third cable arranging structure 134*c*. The cables 120 can be configured in the way shown in FIG. 1 or in the way shown in FIG. 2 according to an actual design requirement, by which the cable arranging can be more flexible.

In the present embodiment, the first cable arranging structure 134*a* has a position limiting space S1, and is adapted to position-limit the cables 120 in the position limiting space S1 as that shown in FIG. 1 or FIG. 2, the second cable arranging structure 134*b* has a position limiting space S2, and is adapted to position-limit the cables 120 in the position limiting space S2 as that shown in FIG. 1, and the third cable arranging structure 134*c* has a position limiting space S3, and is adapted to position-limit the cables 120 in the position limiting space S3 as that shown in FIG. 2, so as to prevent the cables 120 from separating from the main body 132. In other embodiments, the first cable arranging structure 134*a*, the second cable arranging structure 134*b* and the third cable arranging structure 134*c* can be other suitable forms having the cable arranging function, which is not limited by the invention.

Figure 3:
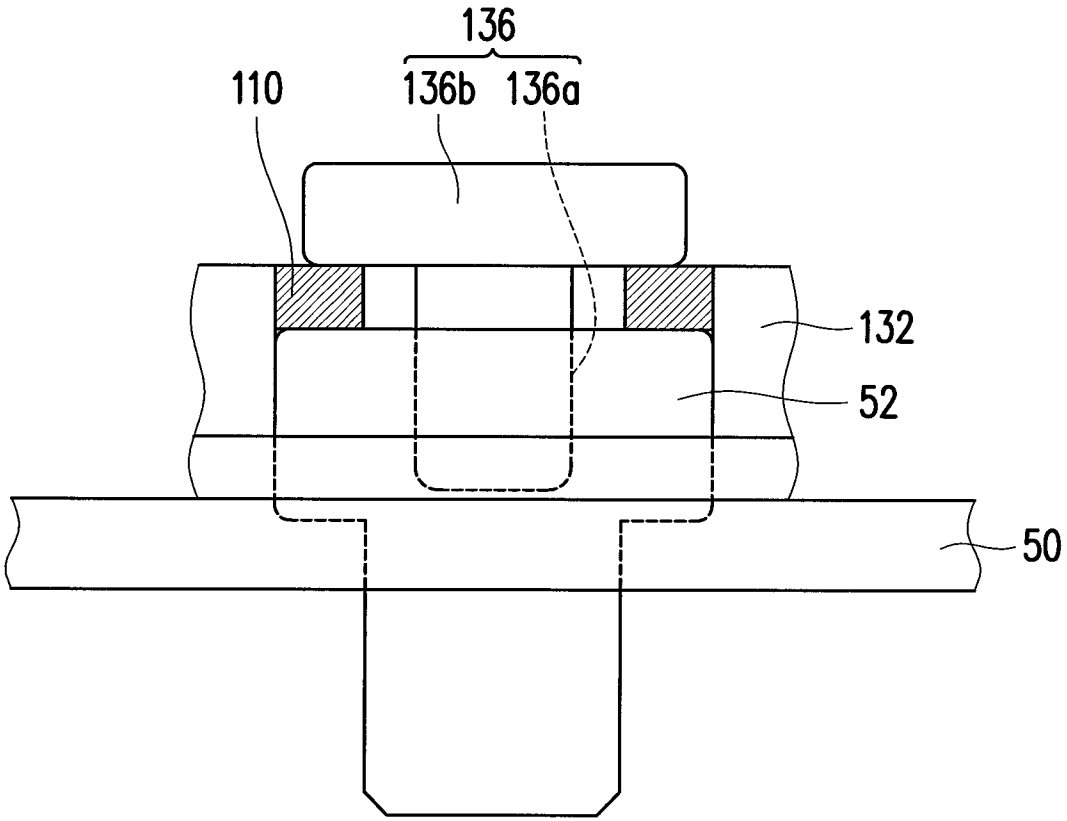
FIG. 3 is a partial cross-sectional view of the network card module and the circuit board of FIG. 1.

FIG. 3 is a partial cross-sectional view of the network card module and the circuit board of FIG. 1. Referring to FIG. 1 and FIG. 3, in detail, the fixing component 136 of the present embodiment is a locking component, and the locking component is, for example, a screw and includes a screw locking portion 136*a* and a stopping portion 136*b*. The screw locking portion 136*a* of locking component is screw-locked to a screw nut 52 on the circuit board 50, and the stopping portion 136*b* of the locking component stops the network card 110 to position-limit the network card 110 on the circuit board 50. Since the network card 110 is fixed to the main body 132 as shown in FIG. 1, in case that the network card 110 is position-limited on the circuit board 50 by the fixing component 136 as that shown in FIG. 2, the main body 132 is also position-limited on the circuit board 50 by the fixing component 136.

Figure 4:
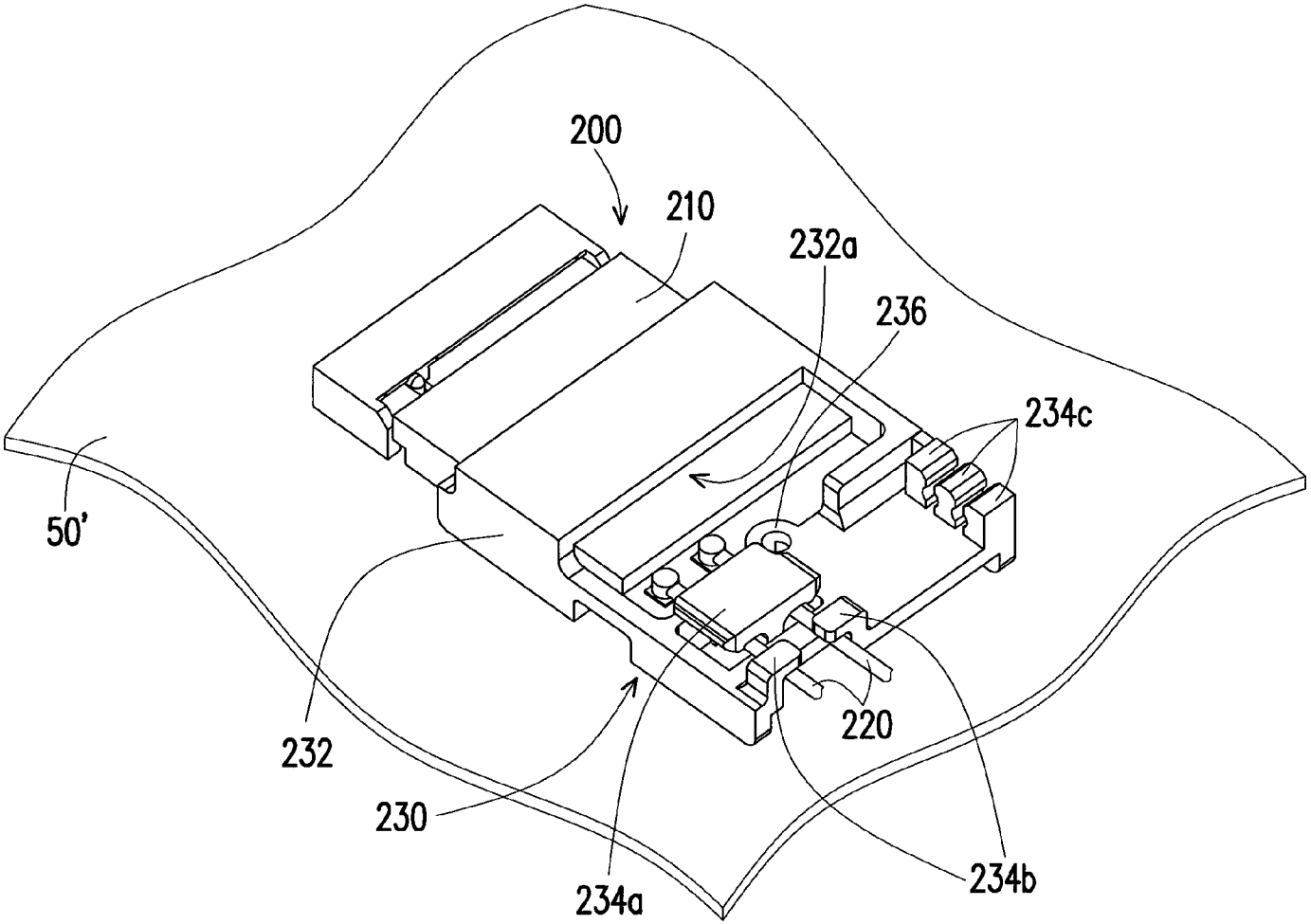
FIG. 4 is a three-dimensional view of a network card module fixed to a circuit board according to another embodiment of the invention.
Figure 5:
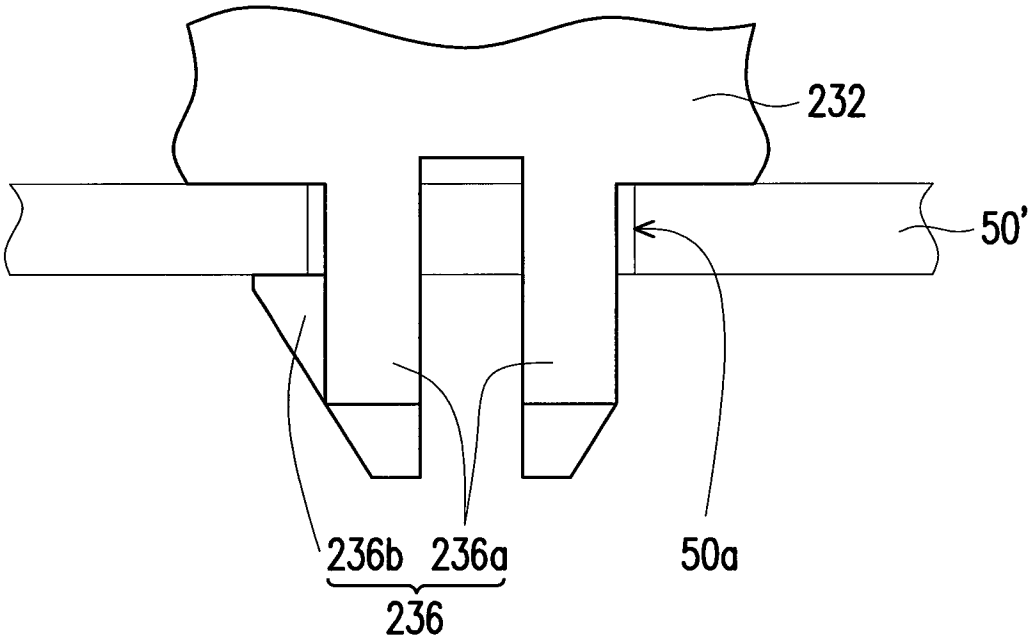
FIG. 5 is a partial side view of the network card fixing structure and the circuit board of FIG. 4.

The form of the fixing component 136 is not limited by the invention, which is described below with reference of FIG. 4 and FIG. 5. FIG. 4 is a three-dimensional view of a network card module fixed to a circuit board according to another embodiment of the invention. FIG. 5 is a partial side view of the network card fixing structure and the circuit board of FIG. 4. In the network card module 200 shown in FIG. 4 and FIG. 5, configurations and functions of a network card 210, cables 220, a network card fixing structure 230, a main body 232, a fixing slot 232*a*, a first cable arranging structure 234*a*, a second cable arranging structure 234*b* and a third cable arranging structure 234*c* are similar to that of the network card 110, the cables 120, the network card fixing structure 130, the main body 132, the fixing slot 132*a*, the first cable arranging structure 134*a*, the second cable arranging structure 134*b* and the third cable arranging structure 134*c* of FIG. 1 and FIG. 2, so that details thereof are not repeated. A difference between the network card module 200 and the network card module 100 is that the fixing component 236 is an engaging component and is connected to the main body 232, and the engaging component is engaged to the circuit board 50' to fix the main body 232 on the circuit board 50'. In detail, the fixing component 236 includes an elastic portion 236*a* and a hook 236*b*. The elastic portion 236*a* and the hook 236*b* can penetrate through an opening 50*a* of the circuit board 50' from top to bottom to present a state shown in FIG. 5 based on elastic deformation of the elastic portion 236*a*, such that the engaging component is engaged to the circuit board 50' through interference between the hook 236*b* and the circuit board 50'. Regarding the implementation of designing the fixing component into the engaging component, a structure and an assembling process thereof can be simplified to save a manufacturing cost. In other embodiment, the fixing component may have other suitable forms, which is not limited by the invention.

Figure 6:
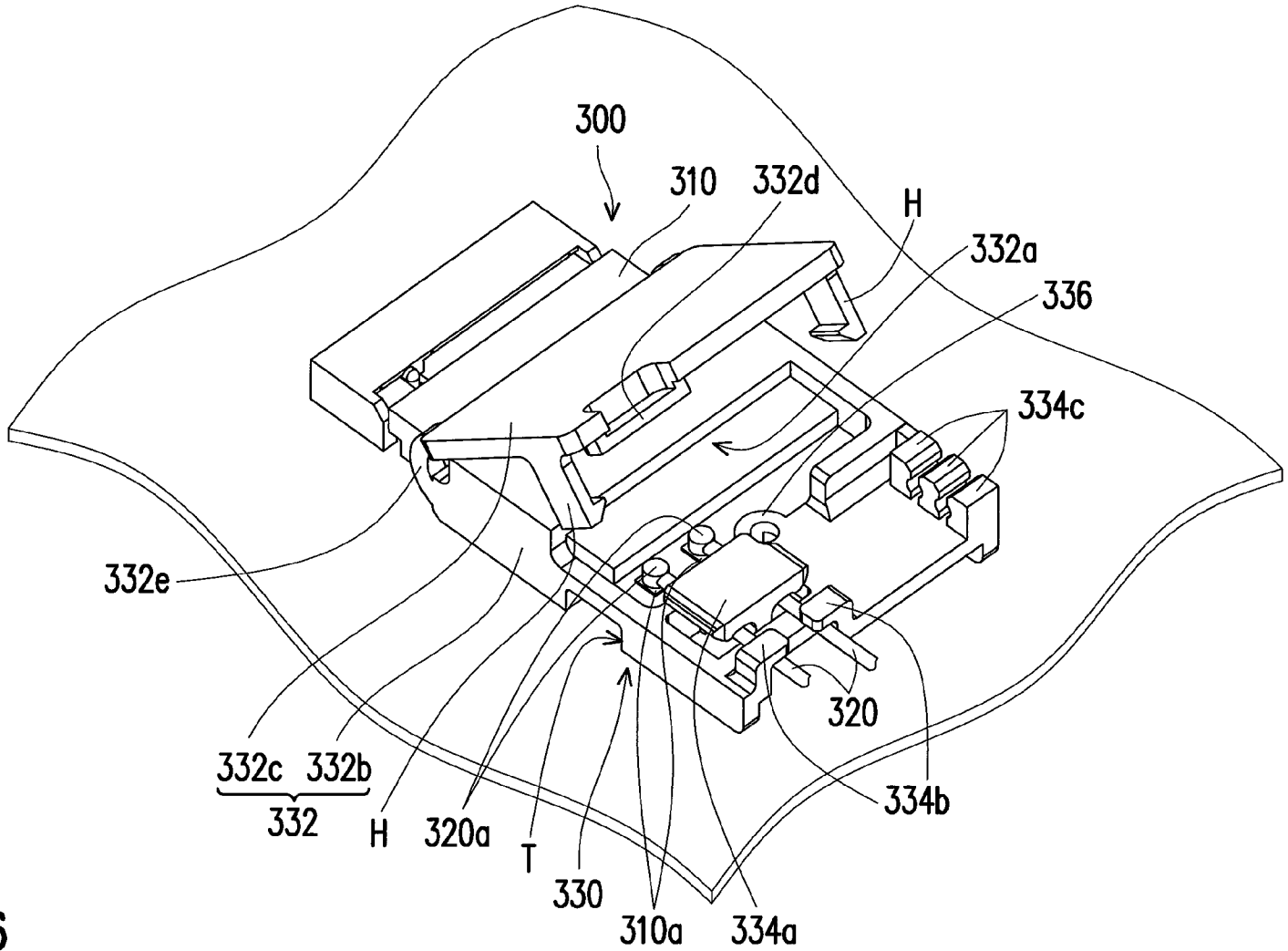
FIG. 6 is a three-dimensional view of a network card module according to another embodiment of the invention.
Figure 7:
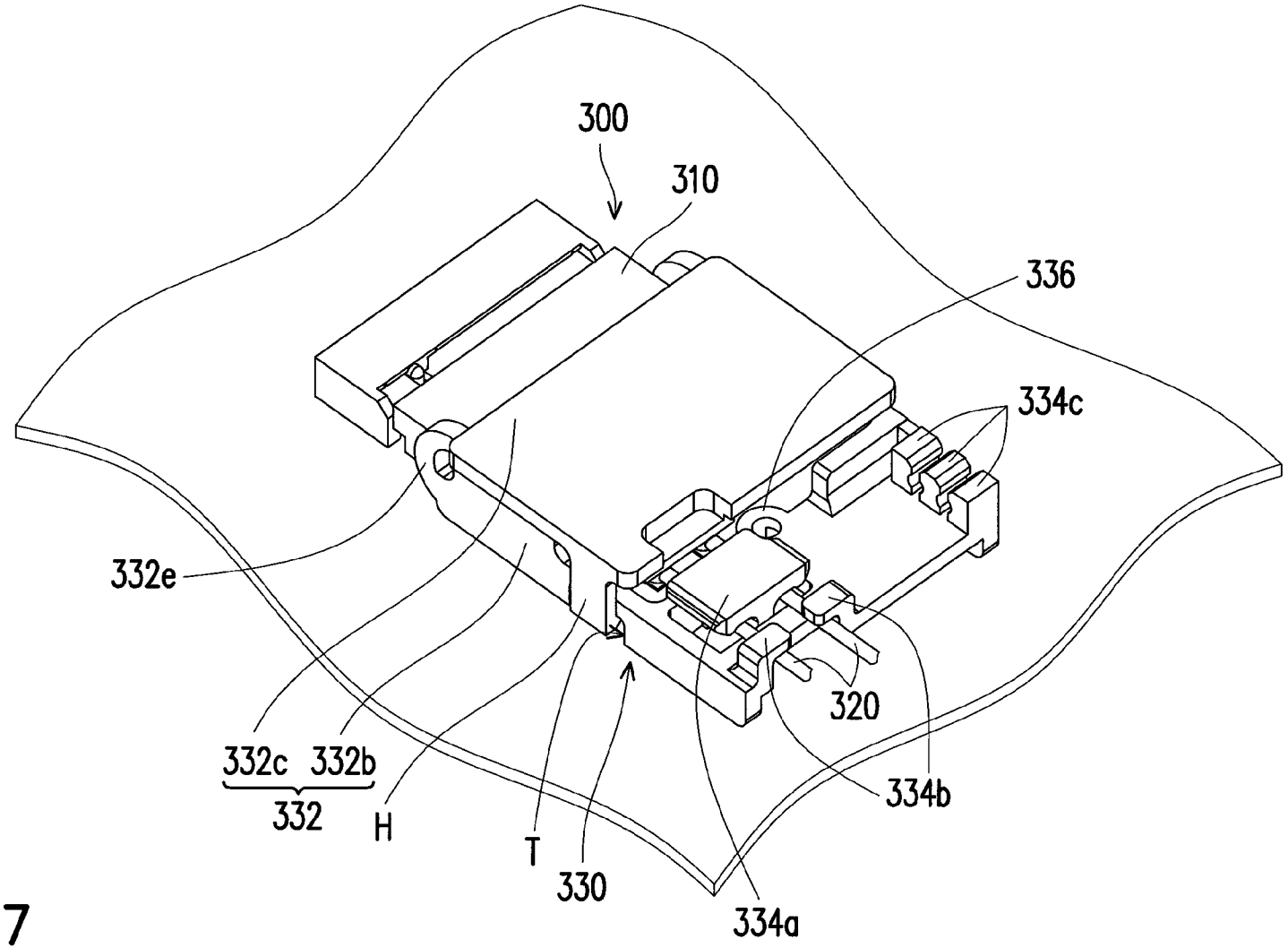
FIG. 7 illustrates a top cover of FIG. 6 closed to a base.

FIG. 6 is a three-dimensional view of a network card module according to another embodiment of the invention. FIG. 7 illustrates a top cover of FIG. 6 closed to a base. In the network card module 300 of FIG. 6 and FIG. 7, configurations and functions of a network card 310, cables 320, a network card fixing structure 330, a main body 332, a fixing slot 332*a*, a first cable arranging structure 334*a*, a second cable arranging structure 334*b*, a third cable arranging structure 334*c* and a fixing component 336 are similar to that of the network card 210, the cables 220, the network card fixing structure 230, the main body 232, the fixing slot 232*a*, the first cable arranging structure 234*a*, the second cable arranging structure 234*b*, the third cable arranging structure 234*c* and the fixing component 236 of FIG. 4 and FIG. 5, so that details thereof are not repeated. A difference between the network card module 300 and the network card module 200 is that the main body 332 includes a base 332*b* and a top cover 332*c*, the main body 332 has a pressing portion 332*d* formed on the top cover 332*c*, and the fixing slot 332*a* used for fixing the network card 310 is formed on the base 332*b*. Each of the cables 320 has a connection terminal 320*a*, and is connected to a pad 310*a* of the network card 310 through the connection terminal 320*a*.

During an assembling and a wire bonding process of the network card module 300, the top cover 332*c* is adapted to be opened relative to the base 332*b* to expose the pads 310*a* of the network card 310 as that shown in FIG. 6, so as to facilitate connecting the connection terminals 320*a* of the cables 320 to the corresponding pads 310*a*. Then, the top cover 332*c* is adapted to be closed to the base 332*b* as that shown in FIG. 7, so as to press the connection terminals 320*a* by the pressing portion 332*d*. Thus, poor contact or exfoliation between the connection terminals 320*a* and the pads 310*a* is avoided.

In the present embodiment, the main body 332 further includes an elastic portion 332*e*. The elastic portion 332*e* is connected between the base 332*b* and the top cover 332*c*, and the base 332*b*, the top cover 332*c* and the elastic portion 332*e* can be formed integrally. The top cover 332*c* is opened or closed relative to the base 332*b* through elastic deformation of the elastic portion 332*e*. Moreover, the top cover 332*c* has a hook H, and the base 332*b* has an engaging trough T. When the top cover 332*c* is closed to the base 332*b* as that shown in FIG. 7, the top cover 332*c* is engaged to the engaging trough T of the base 332*b* through the hook H. In other embodiments, the top cover 332*c* can be engaged to the base 332*b* through other suitable structures, which is not limited by the invention.

In summary, the main body of the network card fixing structure of the invention has the fixing slot to stably fix the network card therein, and the network card fixing structure further includes the cable arranging structures connected to the main body, which are configured to position-limit the cables connected to the network card to the main body. In this way, the network card fixing structure of the invention has both effects of cable arranging and stable fixing of the network card. Moreover, the top cover of the main body can be used to press the connection terminals of the cables to avoid poor contact or exfoliation of the connection terminals, so as to improve reliability of the network card module.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A network card fixing structure, adapted to fix a network card on a circuit board, the network card fixing structure comprising:

a main body, having a fixing slot, wherein the network card is fixed in the fixing slot;

at least one cable arranging structure, connected to the main body, wherein a cable is connected to the network card and is position-limited on the main body by the cable arranging structure; and a fixing component, fixing the main body on the circuit board, wherein the cable has a connection terminal, and is connected to a pad of the network card through the connection terminal, the main body has a pressing portion, and the pressing portion presses the connection terminal on the circuit board.

2. The network card fixing structure as claimed in claim 1, wherein the main body comprises a base and a top cover, the fixing slot is formed on the base, and the pressing portion is formed on the top cover, the top cover is adapted to be opened relative to the base to expose the pad, and the top cover is adapted to be closed to the base, so as to press the connection terminal by the pressing portion.

3. The network card fixing structure as claimed in claim 2, wherein the top cover has at least one hook, and when the top cover is closed to the base, the top cover is engaged to the base through the hook.

4. The network card fixing structure as claimed in claim 3, wherein the base has at least one engaging trough, and when the top cover is closed to the base, the hook is engaged to the engaging trough.

5. The network card fixing structure as claimed in claim 2, wherein the main body further comprises an elastic portion, the elastic portion is connected between the base and the top cover, and the top cover is opened or closed relative to the base through elastic deformation of the elastic portion.

6. The network card fixing structure as claimed in claim 5, wherein the base, the top cover and the elastic portion are formed integrally.

7. The network card fixing structure as claimed in claim 1, wherein the fixing component is a locking component, and the locking component is locked to the circuit board and position-limits the main body on the circuit board.

8. The network card fixing structure as claimed in claim 1, wherein the fixing component is an engaging component and is connected to the main body, and the engaging component is engaged to the circuit board to fix the main body on the circuit board.

9. The network card fixing structure as claimed in claim 1, wherein the cable arranging structure has a position limiting space to position-limit the cable in the position limiting space, so as to prevent the cable from separating from the main body.

10. The network card fixing structure as claimed in claim 1, wherein a number of the at least one cable arranging structure is plural, and the cable arranging structures comprise a first cable arranging structure and a second cable arranging structure, the first cable arranging structure is located between the fixing slot and the second cable arranging structure, the cable is position-limited to the first cable arranging structure, and the cable is adapted to extend from the first cable arranging structure to the second cable arranging structure along a first direction, and is position-limited to the main body by the second cable arranging structure.

11. The network card fixing structure as claimed in claim 10, wherein the cable arranging structures further comprise a third cable arranging structure, and the cable is adapted to extend from the first cable arranging structure to the third cable arranging structure along a second direction, and is position-limited to the main body by the third cable arranging structure.

12. The network card fixing structure as claimed in claim 11, wherein the first direction is perpendicular to the second direction.

13. A network card module, adapted to be fixed on a circuit board, the network card module comprising:

a network card;

a cable, connected to the network card; and a network card fixing structure, comprising:

a main body, having a fixing slot, wherein the network card is fixed in the fixing slot;

at least one cable arranging structure, connected to the main body, wherein the cable is position-limited on the main body by the cable arranging structure; and a fixing component, fixing the main body on the circuit board, wherein the cable has a connection terminal, and is connected to a pad of the network card through the connection terminal, the main body has a pressing portion, and the pressing portion presses the connection terminal on the circuit board.

14. The network card module as claimed in claim 13, wherein the main body comprises a base and a top cover, the fixing slot is formed on the base, and the pressing portion is formed on the top cover, the top cover is adapted to be opened relative to the base to expose the pad, and the top cover is adapted to be closed to the base, so as to press the connection terminal by the pressing portion.

15. The network card module as claimed in claim 13, wherein the fixing component is a locking component, and the locking component is locked to the circuit board and position-limits the main body on the circuit board.

16. The network card module as claimed in claim 13, wherein the fixing component is an engaging component and is connected to the main body, and the engaging component is engaged to the circuit board to fix the main body on the circuit board.

17. The network card module as claimed in claim 13, wherein a number of the at least one cable arranging structure is plural, and the cable arranging structures comprise a first cable arranging structure and a second cable arranging structure, the first cable arranging structure is located between the fixing slot and the second cable arranging structure, the cable is position-limited to the first cable arranging structure, and the cable is adapted to extend from the first cable arranging structure to the second cable arranging structure along a first direction, and is position-limited to the main body by the second cable arranging structure.

18. The network card module as claimed in claim 17, wherein the cable arranging structures further comprise a third cable arranging structure, and the cable is adapted to extend from the first cable arranging structure to the third cable arranging structure along a second direction, and is position-limited to the main body by the third cable arranging structure.

* * * * *